US005945968A

United States Patent [19]

Hush

[11] Patent Number: 5,945,968

[45] Date of Patent: Aug. 31, 1999

[54] MATRIX ADDRESSABLE DISPLAY HAVING PULSED CURRENT CONTROL

[75] Inventor: Glen E. Hush, Boise, Id.

[73] Assignee: Micron Technology, Inc., Boise, Id.

[21] Appl. No.: 08/779,603

[22] Filed: Jan. 7, 1997

[51] Int. Cl.[6] ..... G09G 3/22

[52] U.S. Cl. ..... 345/74

[58] Field of Search ..... 345/74, 75; 315/169.1, 315/169.3; 313/3, 308, 309, 351

[56] References Cited

U.S. PATENT DOCUMENTS

| | | | |
|---|---|---|---|
| 3,761,617 | 9/1973 | Tsuchiya et al. | 178/7.3 D |
| 3,883,778 | 5/1975 | Kaji et al. | 315/205 |
| 4,020,280 | 4/1977 | Kaneko et al. | 358/242 |
| 4,514,727 | 4/1985 | Van Antwerp | 340/793 |
| 4,654,649 | 3/1987 | Kojima et al. | 340/719 |
| 4,743,096 | 5/1988 | Wakai et al. | 350/333 |
| 4,866,349 | 9/1989 | Weber et al. | 315/169.4 |
| 5,036,317 | 7/1991 | Buzak | 340/783 |
| 5,103,144 | 4/1992 | Dunham | 315/366 |
| 5,153,483 | 10/1992 | Kishino et al. | 315/3 |
| 5,196,839 | 3/1993 | Johary et al. | 340/793 |
| 5,210,472 | 5/1993 | Casper et al. | 315/349 |
| 5,212,426 | 5/1993 | Kane | 315/169.1 |
| 5,262,698 | 11/1993 | Dunham | 315/169.1 |
| 5,283,500 | 2/1994 | Kochanski | 315/58 |
| 5,359,256 | 10/1994 | Gray | 313/169 |
| 5,404,081 | 4/1995 | Kane et al. | 315/169.1 |

FOREIGN PATENT DOCUMENTS

| | | | |
|---|---|---|---|
| 0 589 523 A1 | 3/1994 | European Pat. Off. | H01J 31/12 |
| 0 729 128 A2 | 8/1996 | European Pat. Off. | G09G 3/22 |

OTHER PUBLICATIONS

Yokoo, K.; Arai, M.; Mori, M.;Bae, J.; Ono, S. "Active Control of Emission Current of Field Emitter Array," *Revue "le Vide, les Couches Minces"* Suppl. No. 271: 58–61, 1994.

K. Sera, F. Okumura, H. Asada, S. Kaneko, C. Tani, T. Akiyama, J. Yamamoto and Y. Murayama "Poly–Si TFT Active–Matrix Vacuum Fluorescent Display", 2320 Proceedings of the SID 32(1991)No.3, New York, US, pp. 247–250.

*Primary Examiner*—Richard A. Hjerpe
*Assistant Examiner*—Vanel Frenel
*Attorney, Agent, or Firm*—Seed and Berry LLP

[57] ABSTRACT

A current controlled matrix addressable display includes a charging transistor, a driving transistor and a switching transistor that control current flow to a light-emitting assembly. The control circuit is driven by a row signal, a column signal and a clocking signal. The column signal is a combination of an image component and a pulsed charging component. The image component establishes a gate voltage that is trapped at the gate of the charging transistor by the switching transistor in response to the row signal. The clocking signal and the charging component form pulse pairs that transfer charge from a column line to a common node and then from the common node to the light-emitting assembly. The intensity of light is controlled by the voltage difference between the image component and the voltage of the clocking signal. Additionally, the intensity of emitted light can be controlled by controlling the number of pulse pairs in a return interval during which the pulse pairs arrive.

33 Claims, 4 Drawing Sheets

MATRIX ADDRESSABLE DISPLAY HAVING PULSED CURRENT CONTROL

STATEMENT AS TO GOVERNMENT RIGHTS

This invention was made with government support under Contract No. DABT-63-93-C-0025 by ARPA. The government has certain rights to this invention.

TECHNICAL FIELD

The present invention relates to matrix addressable displays, and more particularly to current control circuits in matrix addressable displays.

BACKGROUND OF THE INVENTION

Matrix addressable, flat panel displays are widely used in a variety of applications, including computer displays. One type of device well suited for such applications is the field emission display. Field emission displays typically include a generally planar baseplate beneath a faceplate. The baseplate includes a substrate having an array of projecting emitters. Usually, the emitters are conical projections integral to the substrate and may be grouped into emitter sets where the bases of emitters are commonly connected.

A conductive extraction grid is positioned above the emitters are driven with a voltage of about 30–120 V. The emitters are then selectively activated by providing electrons to the emitters, thereby allowing electrons to be drawn from the emitters by the extraction grid voltage. If the voltage differential between the emitters and the extraction grid is sufficiently high, the resulting electric field extracts electrons from the emitters.

The faceplate is mounted directly adjacent the extraction grid and includes a transparent display screen coated with a transparent conductive material to form an anode that is biased to about 1–2 kV. A cathodoluminescent layer covers the exposed surface of the anode. Electrons emitted by the emitters are attracted by the anode and strike the cathodoluminescent layer, causing the cathodoluminescent layer to emit light at the impact site. The emitted light then passes through the anode and the glass plate where it is visible to a viewer. The brightness of the light produced in response to the emitted electrons depends, in part, upon the number of electrons striking the cathodoluminescent layer in an activation interval, which in turn depends upon the current flow to the emitters. The brightness of each area can thus be controlled by controlling the current flow to the respective emitter or emitter set. The light from each area of the display can thus be controlled to produce an image. The light emitted from each of the areas thus becomes all or part of a picture element or "pixel."

Typically, current flow to the emitters is controlled by controlling the voltage applied to the bases of the emitters to produce a selected voltage differential between the emitters and the extraction grid to produce an intense electric field. The magnitude of the current to the emitters then corresponds to the intensity of the electric field as determined by the voltage differential.

One problem with the above-described approach is that the response of the emitter sets to applied grid and emitter voltages may be non-uniform. Typically, this is caused by variations in the separations between the emitters and the extraction grid across the array, which causes differences in the electric field intensity for a given voltage difference. Often, these separation variations result from variations in the diameter of apertures into which the emitters project, which in turn, are caused by processing variations. Consequently, for a given voltage differential between the emitters and the extraction grid, the brightness of the emitted light may vary according to the location of the emitters.

One way to address such variations may be to employ relatively complex circuitry to fixedly set current through each of the emitters. However, the number of emitters in a field emission display can be substantial. Consequently, simplification of the circuitry for each of the emitters can produce a substantial benefit in overall cost and complexity of the display.

SUMMARY OF THE INVENTION

A current control circuit employs controlled pulsing of a light-emitting assembly in a matrix addressable display for displaying an image in response to an image signal. In a preferred embodiment, the matrix addressable display is a field emission display that includes an array of emitters surrounded by an extraction grid and controlled by the control circuit. The control circuit establishes the current available to the emitters to control the emission of electrons from the emitters. The emitted electrons travel from the emitters through the extraction grid toward a transparent conductive anode at a much higher voltage than the extraction grid. Electrons traveling toward the anode strike a cathodoluminescent layer, causing light to be emitted at the impact sites. Because the brightness of the emitted light depends upon the number of electrons emitted by the emitters in an activation interval, the control circuit controls the brightness of the light by controlling the current flow to the emitters.

In one embodiment, the current control circuit includes a serially connected pair of NMOS transistors connected between a column line and the emitter. The first NMOS transistor is a charging transistor coupled between the column line and a common node joining the pair of NMOS transistors. The second NMOS transistor is a driving transistor coupled between the common node and the emitter. The current control circuit also includes a switching transistor coupled between the column line and the gate of the charging transistor.

A column signal, a row signal, and a clocking signal control the charging, driving, and switching transistors. The column signal is a combination of a pulsed charging component and an image component. The row signal is a binary signal that changes from a low signal to a high signal during a setting interval of the screen. The row signal controls the switching transistor, such that the switching transistor is ON when the row signal is high and the switching transistor is OFF when the row signal is low. Thus, when the row signal is high, the switching transistor passes the column signal to the gate of the charging transistor to set the gate voltage of the charging transistor.

The image component of the column is a variable amplitude, pulsed signal that goes active while the row signal is high. The image component thus sets the gate voltage of the charging transistor, because the switching transistor is ON when the row signal is high. The image component remains high until after the row signal returns low. Thus, the row signal traps the image component on the gate of the charging transistor by turning OFF the switching transistor.

The charging component and the clocking signal are pulsed signals having one or more pulses during an activation interval of the respective emitter. The charging component controls the charging transistor and the clocking signal controls the driving transistor. The clocking signals activate the driving transistor only a portion of the time that the charging component is available at the charging transistor.

A pulse of the charging component turns ON the charging transistor to set the voltage of the common node. Once the common node voltage is established, a pulse of the clocking signal then turns ON the driving transistor to couple the common node to the emitter. The voltage difference between the common node and the extraction grid causes the emitter to emit electrons and produce light, as described above. As electrons are emitted, the common node voltage rises until the common node voltage equals the lesser of the voltage of the clocking signal minus the threshold voltage of the driving transistor and the maximum emission voltage of the emitter.

The rate at which electrons are emitted is determined in part by the voltage change at the common node, which is a function of the gate voltage of the charging transistor. The rate at which electrons are emitted thus depends upon the amplitude of the image component pulse, because the image component pulse establishes the gate voltage of the charging transistor.

In one embodiment of the invention, several pulses of the charging component and clocking signal arrive during each activation interval of the emitter. The total charge transferred to the emitter is thus equal to the number of pulse pairs times the charge transferred for each pulse pair. The brightness of the pixels can thus be varied by varying the number of pulse pairs during each activation interval.

DETAILED DESCRIPTION OF THE INVENTION

Figure 1:
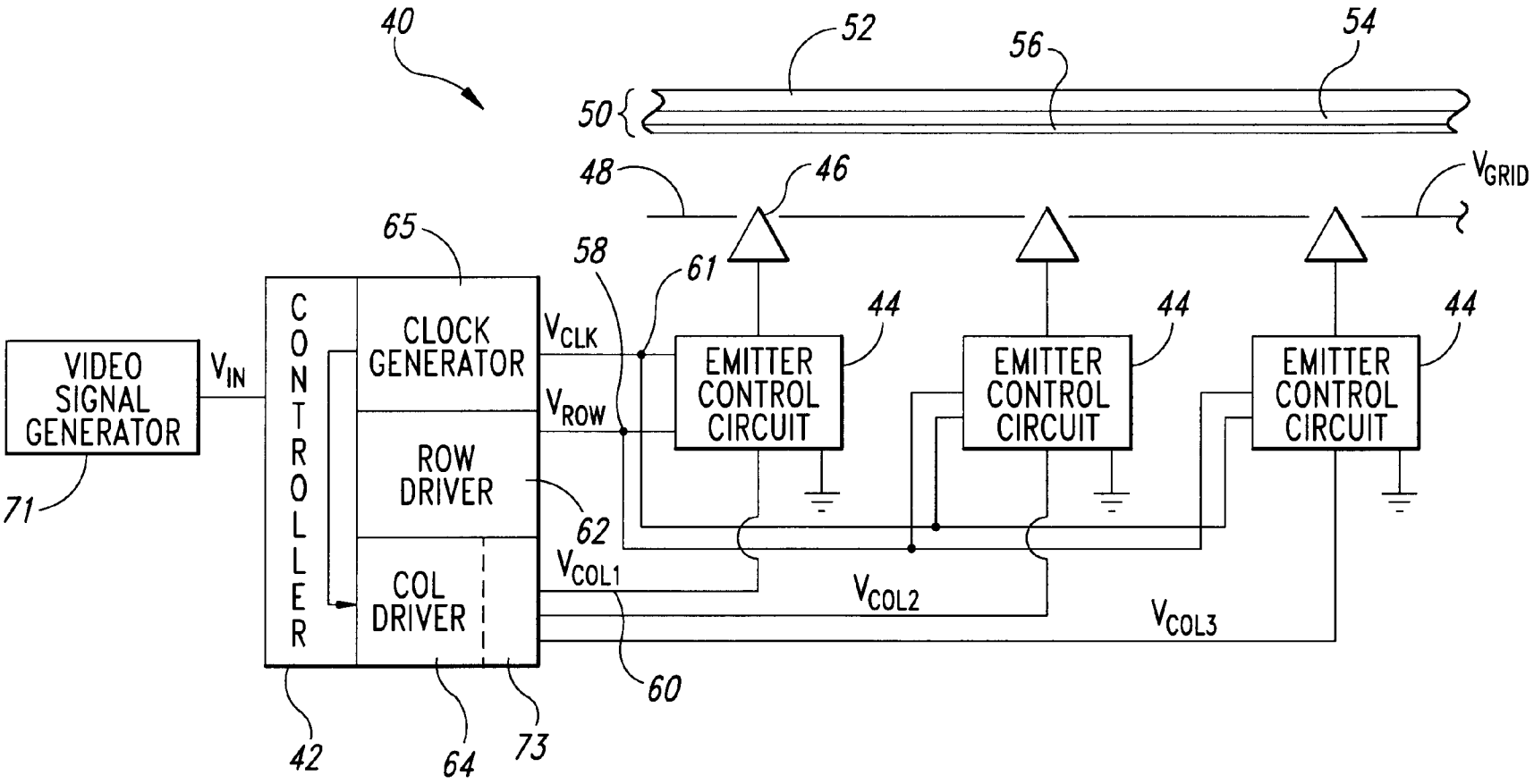
FIG. 1 is a diagrammatic representation of a portion of a field emission display according to one embodiment of the invention showing three emitters controlled by respective current control circuits.

As shown in FIG. 1, a display device 40, which may be a television, computer display, or similar device, includes a plurality of emitters 46 aligned with respective openings in an extraction grid 48 adjacent a faceplate 50. The extraction grid 48 is a conventional extraction grid formed as a planar conductor having several holes, each aligned with a respective emitter 46. The faceplate 50 is a conventional screen formed from a glass plate 52 coated with a transparent conductive anode 54 which is coated, in turn, by a cathodoluminescent layer 56. As is known, during typical operation the extraction grid 48 is biased to approximately 30–120 V and the anode 54 is biased to approximately 1–2 kV.

The emitters 46 are coupled to respective emitter control circuits 44 which are, in turn, driven by a controller 42. While the array is represented by only three control circuits 44 and emitters 46 for clarity of presentation, it will be understood that typical arrays include several hundred control circuits 44 and emitters 46 arranged in rows and columns. Also, each emitter 46 is represented by a single emitter for clarity, although such emitters are typically grouped into sets of more than one emitter where the emitters in each group are commonly connected. Additionally, the displays 40 is presented herein as a monochrome display for clarity of presentation, although one skilled in the art will recognize that the structures and methods herein are equally applicable to color displays.

In operation, a row driver 62, column driver 64 and clock generator 65 within the controller 42 activate selected ones of the emitters 46 by selectively controlling the respective control circuits 44 through row lines 58, column lines 60 and clock lines 61, respectively. The control circuits 44 activate the emitters 46 by providing electrons to the emitters 46. The extraction grid 48 extracts the provided electrons by creating a strong electric field between the extraction grid 48 and the emitter 46. In response, the emitters 46 emit electrons that are attracted by the anode 54. The electrons travel toward the anode 54 and strike the cathodoluminescent layer 56 causing light emission at the impact site. Because the intensity of the emitted light corresponds in part to the number of electrons striking the cathodoluminescent layer 56 during a given activation interval, the intensity of light can be controlled by controlling the electron flow to the emitter 46.

Figure 2:
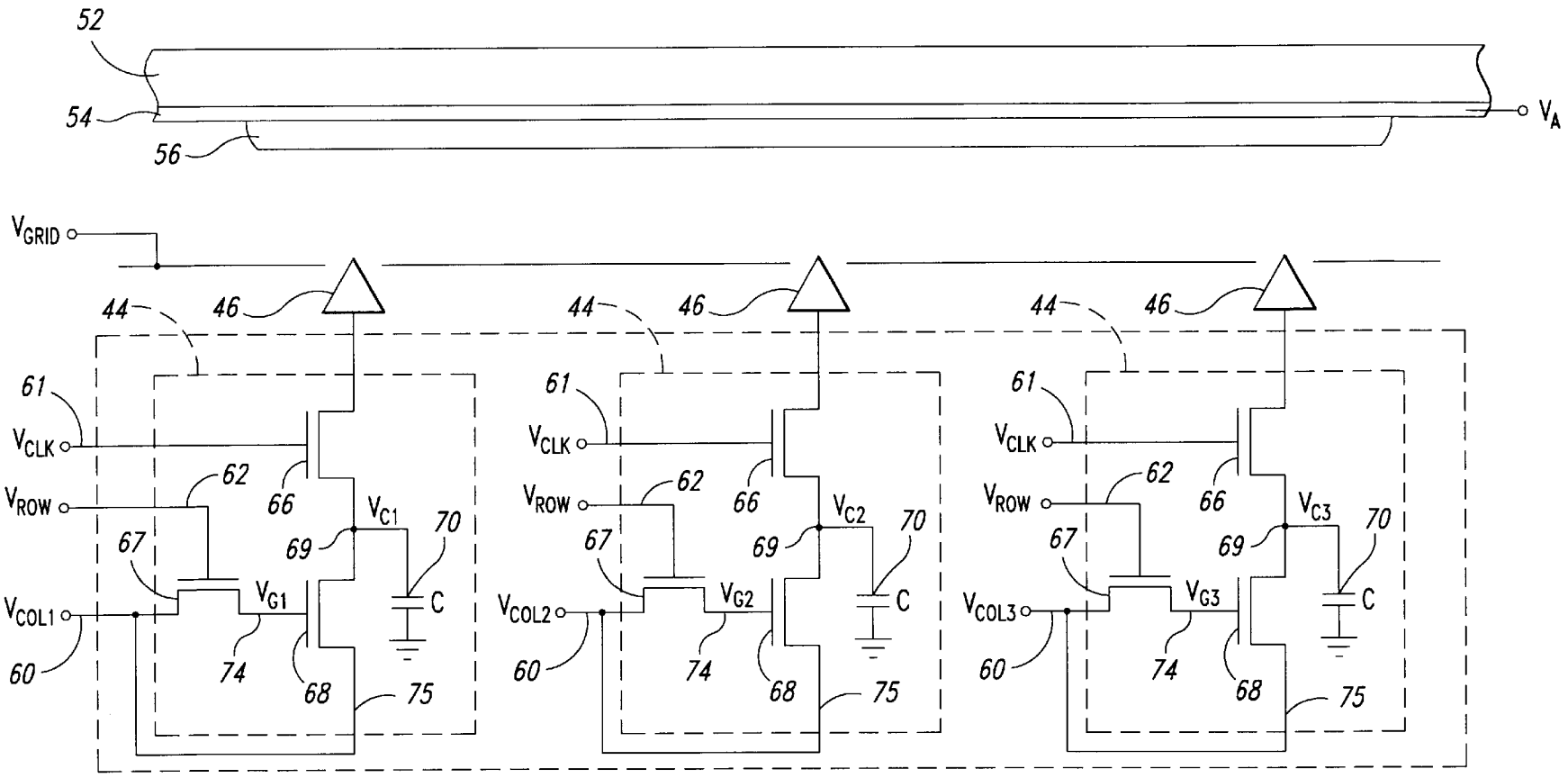
FIG. 2 is a schematic of an embodiment of the invention including switching transistors coupled between respective column lines and the gates of charging transistors and where the sources of the charging transistors are coupled to the respective column lines.

Control of electron flow by the emitter control circuit 44 will now be described with reference to FIGS. 2 and 3. As shown in FIG. 2, the control circuits 44 are formed from NMOS driving transistors 66 and NMOS charging transistors 68 serially coupled at common nodes 69 between the column lines 60 and the emitters 46. The sources of the charging transistors 68 are coupled directly to the column lines 60 while the gates of the charging transistors 68 are coupled to the column line 60 through respective switching transistors 67.

A remaining element of the current control circuit 44 is a circuit capacitance represented as a capacitor 70 connected between the common node 69 and ground. The capacitor 70 preferably is not a separate circuit element. When the transistors 66, 67, 68 are integrated into a substrate, as will be described below with respect to FIG. 4, parasitic capacitances are inherent at the common node 69. Cumulatively, the parasitic capacitances provide sufficient capacitance for operation of the control circuit 44, because of the high impedances presented to the common node 69 by the transistors 66, 68 and because of the low current draw of the emitter 46. For convenience of presentation, the effects of the parasitic capacitances of each control circuit 44 are represented as respective single capacitors 70 in FIG. 2.

The control circuit 44 is controlled by three signals from the controller 42 (FIG. 1). First, the column driver 64 (FIG. 1) provides to each of the control circuits 44 a respective column signal $V_{COL1}$, $V_{COL2}$, $V_{COL3}$ having a variable amplitude image component $V_{IM1}$, $V_{IM2}$, $V_{IM3}$ during a setup interval $T_S$, as shown in FIG. 3. The amplitudes of the image components $V_{IM1}$, $V_{IM2}$, $V_{IM3}$ are established by the controller 42 in response to an input signal $V_{IN}$ from a video signal generator 71 (FIG. 1). Each of the column signals $V_{COL1}$, $V_{COL2}$, $V_{COL3}$ also includes a binary level pulsed charging component $V_{CHG}$ during a return interval $T_R$. The charging component $V_{CHG}$ is produced just prior to a clocking signal $V_{CLK}$ from the clock generator 65, as will be described below. A conventional combining circuit 73, such as a multiplexer, combines the image components $V_{IM1}$, $V_{IM2}$, $V_{IM3}$ and the charging components $V_{CHG}$ to form the column signals $V_{COL1}$, $V_{COL2}$, $V_{COL3}$.

The second signal input to the control circuit 44 is a row signal $V_{ROW}$ that is common to all emitters 46 in the row. The row signal $V_{ROW}$ is a binary signal that goes high during the setup interval $T_S$ at time $t_1$ and returns low at time $t_3$ while all of the pulses of the image components $V_{IM1}$, $V_{IM2}$, $V_{IM}$ are still active. The row signal $V_{ROW}$ controls the gates of all of the switching transistors 67 in the row such that all of the switching transistors 67 in the row are ON when the pulses of the image components $V_{IM1}$, $V_{IM2}$, $V_{IM3}$ are applied. The ON switching transistors 67 couple the image components $V_{IM1}$, $V_{IM2}$, $V_{IM3}$ to the gates of the respective charging transistors 68, thereby establishing gate voltages $V_{G1}$, $V_{G2}$, $V_{G3}$ of the charging transistors 68.

When the row signal $V_{ROW}$ returns low at time $t_3$, all of the pulses of the image components $V_{IM1}$, $V_{IM2}$, $V_{IM3}$ are still active. Thus, the row signal turns OFF the switching transistors 67 and traps the respective gate voltages $V_{G1}$, $V_{G2}$, $V_{G3}$ of the image components $V_{IM1}$, $V_{IM2}$, $V_{IM3}$ at respective nodes 74 between the switching transistors 67 and the charging transistors 68 (i.e., on the gates of the charging transistors 68). After the row signal $V_{ROW}$ goes low, the image components $V_{IM1}$, $V_{IM2}$, $V_{IM3}$ return low at time $t_4$. However, the voltages $V_{G1}$, $V_{G2}$, $V_{G3}$ of the nodes 74 are unaffected, because the switching transistors 67 are OFF, isolating the nodes 74 from the column lines 60.

The third signal input to the control circuits 44 is the clocking signal $V_{CLK}$ that controls the gates of the driving transistors 66. The clocking signal $V_{CLK}$ is a periodic pulsed signal produced by a clock generator 65 in the controller 42 and, like the charging component $V_{CHG}$, the clocking signal $V_{CLK}$ is common to all emitters 46 in the row. The clocking signal $V_{CLK}$ is disabled during the setup interval $T_S$ and is active during the return interval $T_R$. The clocking signal $V_{CLK}$ has an identical period to the charging component $V_{CHG}$. However, the pulses of the clocking signal $V_{CLK}$ have shorter durations than those of the charging component $V_{CHG}$.

The clocking signal $V_{CLK}$ and the charging component $V_{CHG}$ are activated at the end of the setup interval $T_S$ (i.e., after time $t_4$). At this point, the gate voltages $V_{G1}$, $V_{G2}$, $V_{G3}$ of the charging transistors 68 will be held at the voltages of the respective image components $V_{IM1}$, $V_{IM2}$, $V_{IM3}$. In explaining the operation of the charging transistor 68, it should be understood that the lead of the transistor 68 connected to the common node 69 sometimes acts as a drain and sometimes acts as a source. Also, of course, the lead of the transistor 68 connected to a terminal 75 also acts alternatively as a source or a drain. just prior to time $t_5$, the voltages $V_{G1}$, $V_{G2}$, $V_{G3}$ of the node 74 are greater than the voltage on common node 69 so that the lead connected to the common node 69 acts as the source of the transistor 68. The transistor 68 is thus turned ON.

When the charging component $V_{CHG}$ goes high at time $t_5$, the $V_{CHG}$ pulse is coupled through the charging transistors 68 so that the gate-to-source voltages of the charging transistors 68 decrease (since the gate voltage is constant) until the gate-to-source voltages become less than the threshold voltages $V_T$. The charging transistors 68 then turn OFF, thereby leaving the capacitor 70 charged to capacitor voltages $V_{C1}$, $V_{C2}$, $V_{C3}$ equal to the gate voltages $V_{G1}$, $V_{G2}$, $V_{G3}$ minus the gate-to-drain threshold voltages $V_{TD}$ of the charging transistors 68.

Shortly thereafter, at time $t_6$, the clocking signal $V_{CLK}$ goes high, turning ON the driving transistors 66 and coupling the common nodes 69 to the respective emitters 46. The capacitor voltages $V_{C1}$, $V_{C2}$, $V_{C3}$ are less than the grid voltage $V_{GRID}$. Therefore, voltage difference between the emitters 46 and the grid extracts electrons from the emitters 46, thereby removing electrons from the parasitic capacitors 70 and the capacitor voltages $V_{C1}$, $V_{C2}$, $V_{C3}$ rise. The charging transistors 68 do not replace these electrons because the increased capacitor voltages $V_{C1}$, $V_{C2}$, $V_{C3}$ turn the charging transistors 68 further OFF. The capacitor voltages $V_{C1}$, $V_{C2}$, $V_{C3}$ thus gradually rise until the voltage differences between the voltages at the gates of the driving transistors 66 and the capacitor voltages $V_{C1}$, $V_{C2}$, $V_{C3}$ fall below the threshold voltages of the driving transistors 66 such that the driving transistors 66 turn OFF. No more electrons reach the emitters 46 from the common node and the emitters 46 stop emitting electrons. If the pulse interval were to be very short or the capacitors 70 were large, the capacitor voltages $V_{C1}$, $V_{C2}$, $V_{C3}$ may not reach the maximum voltage $V_{MAX}$ prior to the trailing edge of $V_{CLK}$. Then the capacitor voltages $V_{C1}$, $V_{C2}$, $V_{C3}$ would remain at whatever values they reached at the trailing edge of the $V_{CLK}$ pulse at time $t_7$, since the driving transistor 66 is turned OFF at that time.

The charging components $V_{CHG}$ then return low at time $t_8$. Since the node 75 is now at a voltage that is lower than the voltages at nodes 74 and 69, the leads of the charging transistors 68 connected to the nodes 75 act as the sources of the respective charging transistors 68. Thus, when the column voltages $V_{COL1}$, $V_{COL2}$, $V_{COL3}$ go low at $t_8$, the gate-to-source voltages $V_{GS}$ of the charging transistors 68 are sufficient to turn ON the charging transistors 68. Current then flows from the capacitors 70 through the charging transistors 68, thereby discharging the capacitors 70 to the zero volt $V_{COL1}$, $V_{COL2}$ , $V_{COL3}$ signals. The capacitor voltages $V_{C1}$, $V_{C2}$, $V_{C3}$ remain low until the next pair of pulses arrive.

As can be seen from the above discussion, the changes in voltage $\Delta V_{C1}$, $\Delta V_{C2}$, $\Delta V_{C3}$ of the common nodes 69 generally will equal the differences between the maximum voltage $V_{MAX}$ at which the emitter 46 stops emitting, and the voltages of the image components $V_{IM1}$, $V_{IM2}$, $V_{IM3}$ minus the threshold voltages $V_T$ of the charging transistors 68. The total charge from electrons emitted by the emitters 46 in response to each pulse pair thus equals the respective change in capacitor voltage $\Delta V_{C1}$, $\Delta V_{C2}$, $\Delta V_{C3}$ times the capacitance C of the respective capacitor 70 ($\Delta Q = C\Delta V_C$). Thus, the number of electrons emitted in response to each pair of pulses can be controlled by controlling the voltages of the image components $V_{IM1}$, $V_{IM2}$, $V_{IM3}$.

One skilled in the art will recognize that the total emitted charge for each pulse pair is an inverse function of the voltages of the image components $V_{IM1}$, $V_{IM2}$, $V_{IM3}$. For example, if an image component $V_{IM}$ minus the threshold voltage $V_T$ of the charging transistor 68 has an amplitude equal to or greater than the clocking signal voltage minus the threshold voltage $V_T$ of the driving transistor 66, the corresponding capacitor voltage $V_{C1}$, $V_{C2}$, $V_{C3}$ will be equal to or greater than the clocking signal voltage minus the threshold voltage $V_T$ of the driving transistor 66. Consequently, when the clocking signal $V_{CLK}$ goes high at time $t_6$, the gate-to-source voltage of the driving transistor 66 will be less than the threshold voltage. The driving transistor 66 will be OFF and the emitter 46 will emit no electrons. Conversely, when the image component $V_{IM}$ is about equal to the threshold voltage $V_T$ of the charging transistor 68, the change in capacitor voltage $\Delta V_C$ will be large and the number of electrons will be correspondingly large. It should be noted that, if the image component $V_{IM}$ is less than the threshold voltage $V_T$ of the charging transistor 68, the charging transistor 68 will not turn ON, unless the charging component $V_{CHG}$ is allowed to go negative.

As described above, the return interval $T_R$ defines the time over which the emitter 46 is activated and is substantially longer than the durations of the pulses of the charging and clocking signals $V_{CHG}$, $V_{CLK}$. Consequently, several pairs of pulses can arrive within one return interval $T_R$, allowing the capacitor 70 to charge and discharge several times. The total transferred charge $Q_{TOT}$ in the return interval $T_R$ will equal the number N of pulse pairs times the capacitance C of the capacitor 70 times the change in the capacitor voltage $\Delta V_C$. Thus, by using several pulse pairs, the display 40 transfers more charge to the emitter 46 during the return interval $T_R$ than a single pulse pair, thereby emitting light more efficiently.

As an alternative or complement to controlling the brightness by controlling the voltage of the image component $V_{IM}$, the brightness can be controlled by controlling the number N of pulse pairs in a given return interval $T_R$. For example, reducing the number N of pulse pairs to only one during the return interval $T_R$ will provide a minimum brightness for a given voltage of the image component $V_{IM}$. Thus, the number of electrons emitted by the emitter 46 can be controlled by varying the number of pulse pairs N within the return interval $T_R$ and/or by controlling the voltage of the image component $V_{IM}$.

Figure 3:
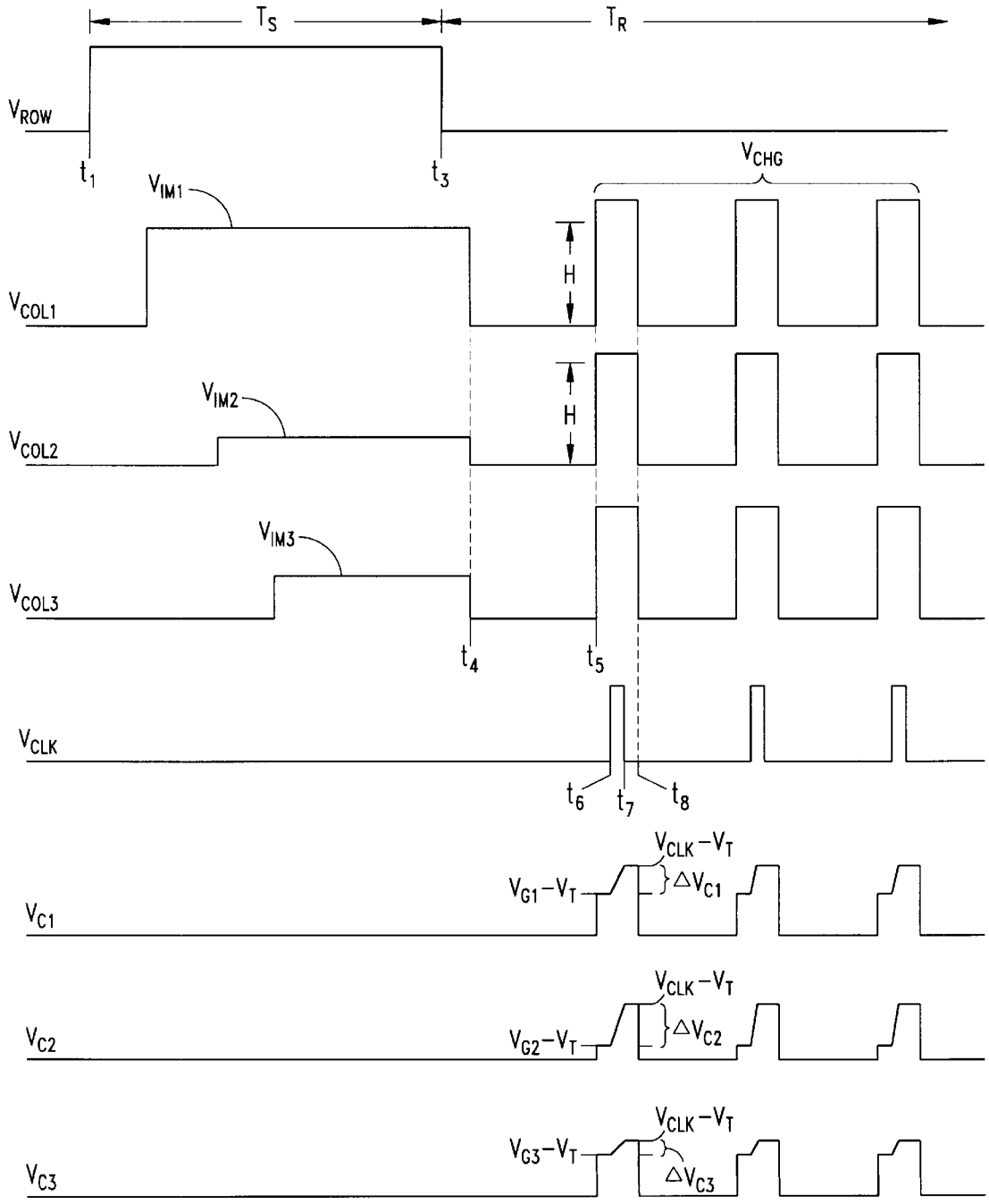
FIG. 3 is a signal timing diagram of signals for driving the circuit of FIG. 2.
Figure 4A:
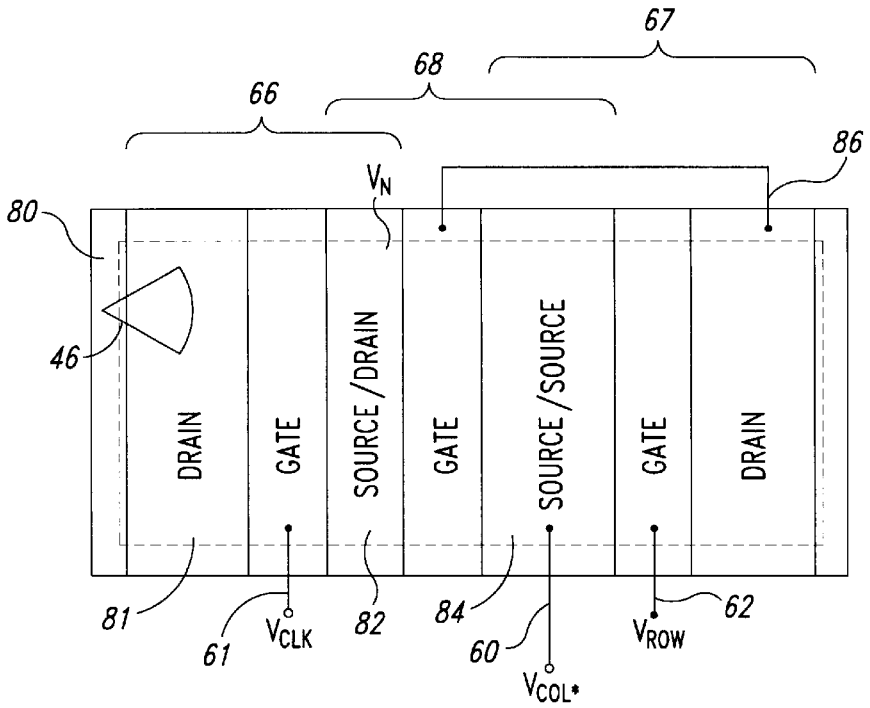
FIG. 4A is a top plan view of an embodiment of one of the control circuits of FIG. 2 showing a three transistor integrated structure in a common well.
Figure 4B:
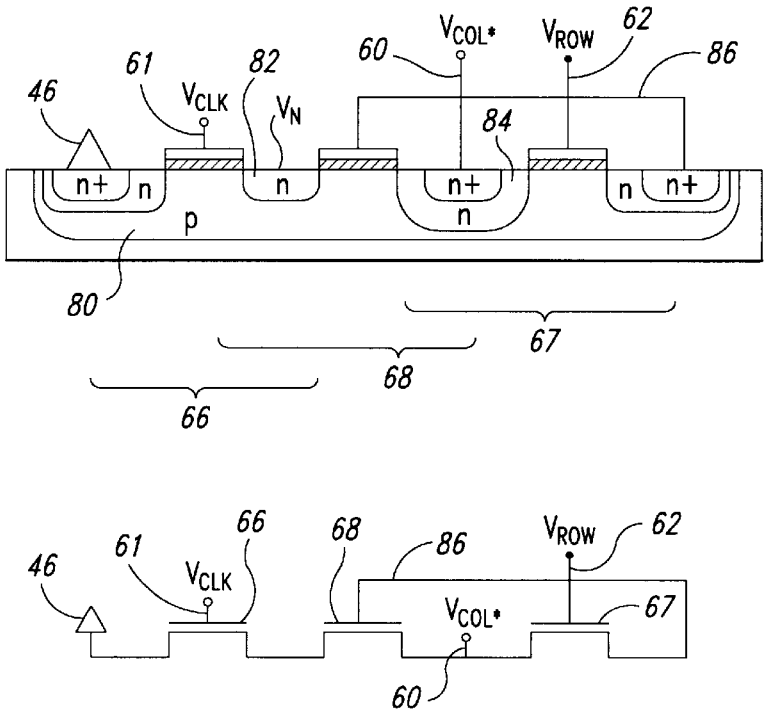
FIG. 4B is a side cross-sectional view of the three transistor integrated structure of FIG. 4A and includes a schematic showing correspondence between the integrated structure and the control circuit elements.

As shown in FIGS. 4A and 4B, the interconnect structure of FIG. 3 of the transistors 66, 67, 68 allows all three transistors 66, 67, 68 in each control circuit 44 to be integrated into a common p-well 80. In the integrated structure, the source of the driving transistor 66 and the drain of the charging transistor 68 share a common n-region of the p-well 80 that forms the common node 69. Parasitic capacitances at the common region 82 form the capacitor 70. Similarly, the source of the charging transistor 68 and the source of the switching transistor 67 share a common n-region 84 of the well 80. The common region 84 thus forms the location to which the column line 60 is coupled. To complete the circuit structure, a conductive interconnect 86 couples the drain of the switching transistor 67 to the gate of the charging transistor 68. Advantageously the emitter 46 can be formed directly atop the drain 81 of the driving transistor 66. Such an integrated structure reduces the amount of substrate area occupied by the control circuit 44, as compared to structures which utilize more than one p-well 80.

While the principles of the invention have been illustrated by describing various structures for controlling current to the emitter 46, various modifications may be made without deviating from the spirit and scope of the invention. For example, the transistors 66, 67, 68 can be formed in an n-well or directly in a p-type or n-type substrate. Similarly, the parasitic capacitor 70 can be replaced or supplemented by a discrete capacitor. Also, although the clocking signal $V_{CLK}$ has been described as being common to emitters 46 in a single row, a common clocking signal $V_{CLK}$ could be used for all emitters 46 in the array. Accordingly, the invention is not limited except as by the appended claims.

I claim:

1. An emitter driving circuit for a field emission display, the drive circuit having a signal input, a switch control input, and an output coupled to an emitter, the drive circuit comprising:

a charge storage circuit coupled to the output;

a first switch having a first terminal coupled to the signal input, a second terminal coupled to a circuit node, and a switch control terminal coupled to the switch control input, the first switch being opened or closed responsive to respective signals applied to the switch control input; and a second switch having a first terminal coupled to the signal input, a second terminal coupled to the charge storage circuit, and a control terminal coupled to the circuit node, the second switch being opened or closed responsive to a voltage differential between a voltage of the charge storage circuit and a voltage of the circuit node, the charge storage circuit being charged to a first voltage by a signal applied to the signal input when the second switch is closed, the charge storage circuit being charged by current from the emitter when the second switch is open.

2. The emitter driving circuit of claim 1 wherein the charge storage circuit is a capacitor.

3. The emitter driving circuit of claim 2 wherein the capacitor is a parasitic capacitance of the first and second switches.

4. The emitter driving circuit of claim 2 wherein the voltage on the capacitor increases responsive to being charged by current from the emitter when the second switch is open, and wherein current flows from the emitter to charge the capacitor until the voltage on the capacitor reaches a voltage at which the voltage on the capacitor coupled to the emitter rises to a level that prevents the emitter from continuing to emit electrons.

5. The emitter driving circuit of claim 1, further comprising a third switch having a first terminal coupled to the charge storage circuit, a second terminal coupled to the output, and a switching terminal, the third switch being opened or closed responsive to a clocking signal at the switching terminal, the third switch in its closed state providing a path for current to flow from the emitter to the charge storage circuit.

6. The emitter driving circuit of claim 5 wherein the first, second and third switches are transistors.

7. The emitter driving circuit of claim 6 wherein the first, second and third transistors are integrated into a common well of a substrate.

8. A matrix addressable display, comprising:

a plurality of light-emitting assemblies arranged in rows and columns; and a driving circuit having an output coupled to one of the light-emitting assemblies, a signal input and a switching input, the driving circuit including:

a charge storage circuit coupled to the output including a voltage storage node;

a first switch coupled between the signal input and the voltage storage node, the first switch having a first control terminal coupled to the switching input, the first switch being responsive to a switching voltage at the first control terminal to selectively couple the signal input to the voltage storage node; and a charging circuit having a charging control terminal coupled to the voltage storage node, a first terminal coupled to the signal input and a second terminal coupled to the charge storage circuit, the charging circuit being responsive to provide a current path between the first and second terminals in response to a voltage at the charging control terminal exceeding either the voltage at the first terminal or the voltage at the second terminal by respective threshold voltages.

9. The matrix addressable display of claim 8 wherein the driving circuit further includes:

a clocking input; and a driving switch coupled between the charge storage circuit and the output, the driving switch having a control terminal coupled to the clocking input, the driving switch being configured to transfer charge from the charge storage circuit to the light-emitting assembly in response to a clocking signal at the first clocking input.

10. The matrix addressable display of claim 8 wherein the charge storage circuit includes a storage capacitance.

11. The matrix addressable display of claim 10 wherein the storage capacitance includes a discrete capacitor.

12. A driving circuit for activating light-emitting assemblies in a matrix addressable display in response to an image signal, a first clocking signal and a second clocking signal, comprising:

a first circuit portion having a first driving input, a first output coupled to the light-emitting assembly and a first clocking input, the first circuit portion being responsive to transfer charge from the first driving input to the light-emitting assembly in response to the first clocking signal at the first clocking input; and a second, circuit portion including an input terminal configured to receive the image signal during a first interval and to receive a second clocking signal during a second interval following the first interval, the second circuit portion further including a second output coupled to the first driving input and a storage circuit, the second circuit portion being responsive to store charge in the storage circuit during the second interval as a function of the image signal and to transfer the stored charge from the storage circuit to the first driving input in response to the second clocking signal.

13. The driving circuit of claim 12 wherein the second circuit portion further includes:

a charging switch coupled between the input terminal and the storage circuit, the charging switch including a switching terminal; and a switching circuit coupled between the input terminal and the switching terminal, the switching circuit including a control input and being configured to couple signals from the input terminal to the switching terminal in response to a control signal at the control input of a first state and to isolate the input terminal from the switching terminal in response to a control signal of a second state at the control input.

14. The driving circuit of claim 13 wherein the first and second circuit portions include first and second transistors, respectively.

15. The driving circuit of claim 14 wherein the switching circuit is a third transistor.

16. The driving circuit of claim 15 wherein the first, second and third transistors are integrated into a contiguous region of a material of a first doping type in a substrate.

17. The driving circuit of claim 16 wherein the matrix addressable display is a field emission display and the light-emitting assembly includes an emitter, wherein the contiguous region of the material of the first doping type carries the emitter.

18. The driving circuit of claim 17 wherein the first transistor includes a plurality of regions of a material of a second doping type wherein one of the regions of the material of the second doping type is coupled to the emitter.

19. The driving circuit of claim 12 wherein the storage circuit includes a capacitance.

20. An apparatus for displaying an image, comprising:

an image signal generator operative to produce an image signal corresponding to the image;

a screen assembly;

an array of emitters aligned with the screen assembly; and a driving circuit coupled to a selected one of the emitters, the driving circuit including:

a first switching circuit having a first signal input coupled to the image signal generator, a first output for providing a node voltage and a first clocking input;

a second switching circuit having a second signal input coupled to the image signal generator, a second output coupled to the emitter, and a control input coupled to the first output; and a charge storage circuit coupled between the second switching circuit and the emitter.

21. The apparatus of claim 20 wherein the signal generator includes:

a video signal generator having a video output for providing a video output signal;

a clock source having a clock output for providing a charging signal; and a combining circuit having a first input coupled to the video output and a second input coupled to the clock output, the combinging circuit being configured to produce the image signal as a function of the video output signal and charging signal.

22. The apparatus of claim 21 wherein the combining circuit includes a multiplexer.

23. The apparatus of claim 20, further including a third switching circuit coupled between the charge storage circuit and the emitter, the third switching circuit including a control input, the third switching circuit being responsive to transfer charge from the charge storage circuit storage circuit to the emitter in response to a control signal at the control input.

24. The apparatus of claim 23 wherein the second switching circuit is configured to provide a current path from the second signal input to the charge storage circuit until the voltage differential between the voltage of the charge storage circuit and the node voltage reaches a predetermined level.

25. The apparatus of claim 23 wherein the first, second and the third switching circuits include first, second and third transistors, respectively.

26. The apparatus of claim 25 wherein the first, second and third transistors are integrated into a common well.

27. A method of controlling a matrix addressable display including an array of ligh-emitting assemblies in response to an image signal, comprising:

establishing a setup interval by providing an activation signal in a first state during a first period of time;

establishing a return interval by providing the activation signal in a second state during a second period of time;

providing a driving signal having a first component with a voltage corresponding to the image signal during the setup interval and a second component having a periodic voltage during the return interval;

providing a first clocking signal during the return interval;

storing a voltage corresponding to the driving signal during the setup interval; and in response to the periodic voltage and the first clocking signal, providing a signal corresponding to the stored voltage to a selected one of the light-emitting assemblies during the return interval.

28. The method of claim 27 wherein in response to the periodic voltage and the first clocking signal, providing a signal corresponding to the stored voltage to a selected one of the light-emitting assemblies includes:

storing a first charge in response to a first pulse of the periodic voltage; and transferring the stored first charge to the light-emitting assembly in response to a pulse of the first clocking signal.

29. The method of claim 28, further comprising:

storing a second charge in response to a second pulse of the period voltage; and transferring the stored second charge to the light-emitting assembly in response to a second pulse of the first clocking signal.

30. The method of claim 27 wherein the matrix addressable display includes an image signal input and providing a driving signal includes providing both the first and second components to the image signal input.

31. A method of activating an emitter in response to an image signal having an activation component and an image component wherein the activation component has a setup interval and a return interval, comprising:

combining the image component with a periodic charging signal to produce a driving signal having a voltage that is a function of the image component during the setup interval and that corresponds to the charging signal during the return interval;

storing a voltage corresponding to the driving signal in response to the activation component; and transferring a quantity of charge corresponding to the stored voltage to the emitter in response to the driving signal during the return interval.

32. The method of claim 31, further including providing a periodic clocking signal having a period substantially equal to the period of the charging signal.

33. The method of claim 32 wherein the step of transferring a quantity of charge corresponding to the stored voltage to the emitter in response to the driving signal includes the step of closing a switch between the stored voltage and the emitter.

* * * * *

UNITED STATES PATENT AND TRADEMARK OFFICE

CERTIFICATE OF CORRECTION

PATENT NO. : 5,945,968
DATED : August 31, 1999
INVENTOR(S) : Glen E. Hush

It is certified that error appears in the above-identified patent and that said Letters Patent is hereby corrected as shown below:

| | Reads | Should Read |
|---|---|---|
| Column 4, line 9 | "display" | - - displays - - |
| Column 5, line 8 | "$V_{IM}$" | - - $V_{IM3}$ - - |
| Column 5, line 15 | "$_{VG2}$" | - - $V_{G2}$ - - |
| Column 5, line 51 | "just" | - - Just - - |

Signed and Sealed this

Eighth Day of May, 2001

*Attest:*

Nicholas P. Godici

NICHOLAS P. GODICI

*Attesting Officer*

*Acting Director of the United States Patent and Trademark Office*